United States Patent [19]

Simmon

[11] Patent Number: 4,837,869

[45] Date of Patent: Jun. 13, 1989

[54] CHAIR FOR USE IN SWIMMING POOLS

[76] Inventor: Todd R. Simmon, 11777 Gayview Dr., La Mirada, Calif. 90638

[21] Appl. No.: 161,485

[22] Filed: Feb. 29, 1988

[51] Int. Cl.[4] ..... E04N 3/18

[52] U.S. Cl. ..... 4/496; 4/579; 4/559; 297/14; 297/217

[58] Field of Search ..... 4/496, 578, 579, 560, 4/559, 564, 565, 566; 297/14, 250, 254, 217

[56] References Cited

U.S. PATENT DOCUMENTS

| | | | |
|---|---|---|---|
| 546,180 | 9/1895 | Newman et al. | 4/579 |
| 893,930 | 7/1908 | Lederman | 4/579 |
| 1,245,660 | 11/1917 | Behm | 4/579 |
| 1,371,715 | 3/1921 | West | 4/579 X |
| 1,824,396 | 9/1931 | Erhard et al. | 4/579 |
| 2,142,263 | 1/1939 | Bentz | 4/579 |
| 4,468,822 | 9/1984 | McKay | 4/496 |

FOREIGN PATENT DOCUMENTS

| | | | |
|---|---|---|---|
| 19089 | of 1904 | Austria | 4/579 |
| 544131 | 10/1930 | Fed. Rep. of Germany | 4/579 |
| 706780 | 6/1931 | France | 4/579 |

*Primary Examiner*—Frankie L. Stinson

*Attorney, Agent, or Firm*—Edgar W. Averill, Jr.

[57] ABSTRACT

A chair supported on the coping and side of a swimming pool, spa or other aquatic body. The chair is held by a support arm which rests on the surface of the coping. The chair also has a leg which extends to the side of the swimming pool below the water line to hold the seat of the chair away from the side of the pool.

16 Claims, 1 Drawing Sheet

34
32
11
15
14
30
13
31
29
26
10
12
17
21
25
27
24
22
23
20
19
33
16
18

15
34
11
10
31
14
13
31
16
12
18
32
17

34
13
31
11
25
26
24
27
10
28
29
31
32
12
23
22
20
19
16
18

10
13, 14
5
8
7
12
6
9
16, 17

49
41
39'
40
39
26
36
44
25
46
43
45
50
51
42
35
47
38
48
37

53
52
55
54

CHAIR FOR USE IN SWIMMING POOLS

BACKGROUND OF THE DISCLOSURE

The field of the invention is recreational equipment and the invention relates more particularly to recreational equipment for use in swimming pools, spas or other aquatic bodies.

The typical swimming pool chair is a floating chair and one such chair is shown in U. S. Pat. No. 3,117,327. While such chairs have found widespread use, some people find them uncomfortable because of their bobbing movement particularly when other people are using the pool. Furthermore, they tend to float in a random manner, and for someone wishing to improve their suntan, it is advantageous to have a chair which may be held in a desired orientation.

SUMMARY OF THE INVENTION

It is an object of the present invention to provide a chair for use in swimming pools, which chair does not float but instead is supported by the structure of the swimming pool.

The present invention is for a chair supported on the coping and side of a swimming pool, spa or other aquatic body. The chair and pool combination includes pool coping means at the side of a swimming pool, said pool coping means having a pool edge above a generally vertical pool side and said swimming pool includes pool sides and a water line below the pool coping means. A pool chair includes a generally horizontal seat and a generally vertical back affixed to the seat. The generally vertical back has two sides and has a bar affixed to the generally vertical back, which bar is supported by the coping. The coping-supported bar is positioned atop the pool coping means and extends away form the vertical back of the pool chair. The pool chair has pool side contact means located below the water line of the pool and affixed to the pool chair contacting the side of the swimming pool to hold the seat of the pool chair away from the side of the pool. In a preferred embodiment, the side contact means is an extension of the side bars of the seat and the generally vertical back is slidingly attached to these side bars.

DESCRIPTION OF THE PREFERRED EMBODIMETNS

Figure 1:
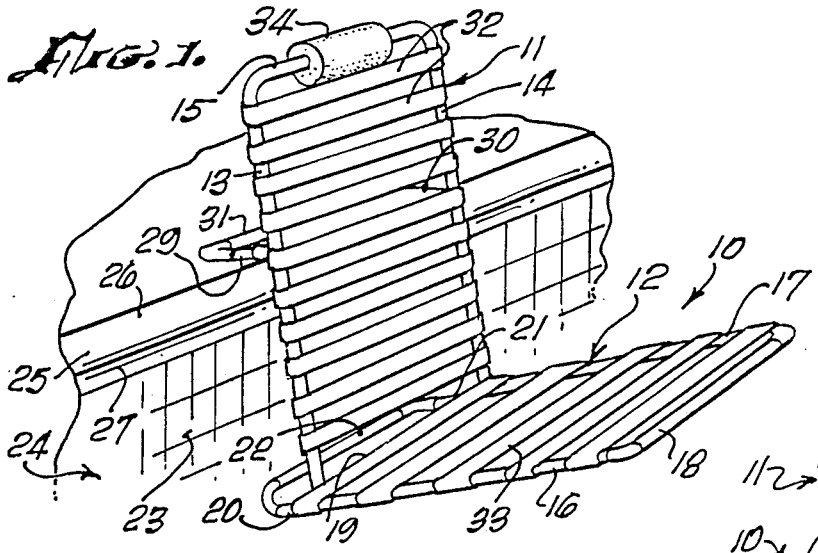
FIG. 1 is a perspective view of the pool chair of the present invention supported by the coping and side of a swimming pool.
Figure 2:
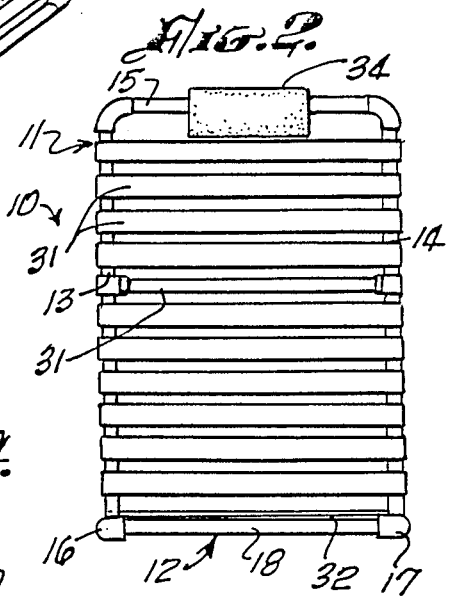
FIG. 2 is a front view of the chair of FIG. 1.
Figure 3:
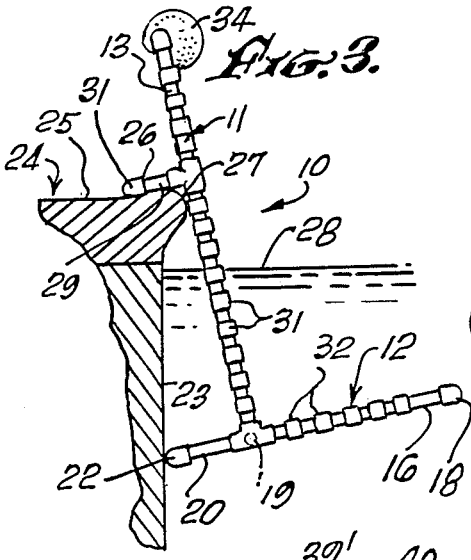
FIG. 3 is a side view of the pool chair and pool side of FIG. 1.

The pool chair of the present invention is shown in perspective view in FIG. 1 and indicated generally by reference character 10. Pool chair 10 has a generally vertical back 11 and a generally horizontal seat 12. The vertical back has two sides 13 and 14, and a top 15. The seat 12 has two sides 16 and 17, a front bar 18 and a back bar 19. Pool side contact means are provided by a pair of bars 20 and 21 which are attached at their outer end by a cross member 22. Bars 20 and 21 and cross member 22 contact the side 23 of the swimming pool 24. Swimming pool 24 has a number of coping tiles 25 which provide the coping of the pool As shown in FIG. 3, the coping tiles have a surface 26 which slopes away from the pool edge of the coping 27. The pool edge of the coping 27 is located above the water line 28 at the side 23 of the pool. Chair 10 is given vertical support by a pair of coping supported bars 29 and 30 which are attached at their outer ends by a cross member 31. Generally vertical back has webbing 32 and generally horizontal seat has webbing 33.

Figure 4:
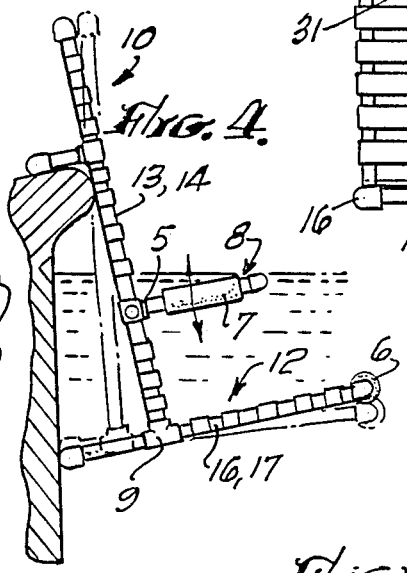
FIG. 4 is a side view of an alternate embodiment of the pool chair and pool side of FIG. 1.

An adjustable version of the pool chair 10 is shown in FIG. 4. The vertical side members 13 and 14 of back 11 are slideably attached to sides 16 and 17 of seat 12. This is accomplished by the use of tee 9 which is attached to side 13 and is slidable along side 16. Preferably, a set screw, not shown, is used to hold tee 9 in a desired location. The point of attachment of tee 9 determines the tilt of the seat and back. Also, the sides of pools are not always vertical and this adjustment of tee 9 can compensate for different pool side slopes.

Preferably, the sides 13 and 14, top 15, back bar 19, sides 16 and 17 and front bar 18 are all fabricated from a polymer such as poly vinyl chloride. Similarly, the bars 20, 21 and cross member 22 and bars 29, 30 and cross member 31 are also fabricated from a polymer such as poly vinyl chloride which, preferably should be white so that it does not tend to mark the side of the pool which is normally white plaster.

As can be seen best in FIG. 3, the pool chair is supported in a manner so that the seat 12 is below the water line 28 so that the user thereof is comfortably seated partially below water and partially above water. The chair 10 can be placed at any position around the pool so that the sunlight is directed in most advantageous direction. A headrest 134 is placed along top 15. Because the user is largely under water when using the pool chair of the present invention the materials of constriction of chair 10 need not be exceptionally strong. For instance, schedule 40, ½ inch diameter pvc pipe; is sufficiently strong.

Arm rests 8 are shown on the chair 10 of FIG. 4 for added comfort. These are attached to sides 13 and 14 by tees 5 which are also preferably adjustable as by a set screw to permit the arms to be placed at a comfortable position by the user. Sponge tubing 7 is affixed over the arm rest and a length of sponge tubing 6 is placed over front bar 18 of the chair of FIG. 4.

Figure 5:
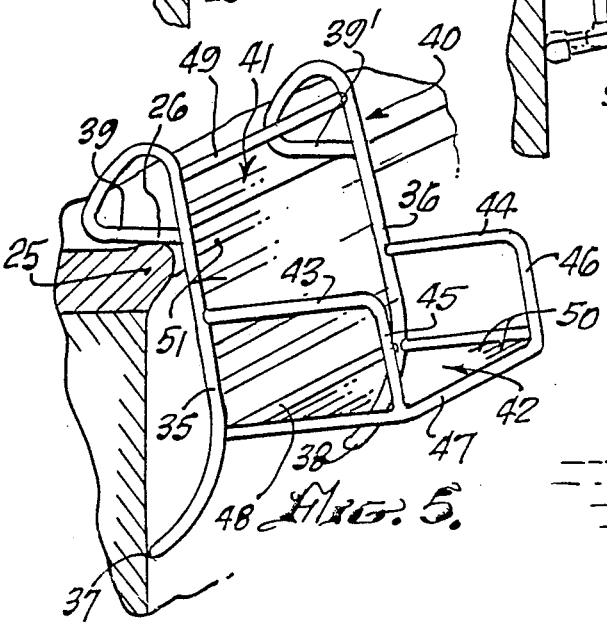
FIG. 5 is a perspective view of an alternate embodiment of the pool chair of FIG. 1 supported by a pool coping and pool side.

An alternate design of the pool chair of the present invention is shown in FIG. 5 where two side members 35 and 36 are curved to form two points of contact 37 and 38 with the side 23 of pool 24. Similarly, the sides are curved and have two generally horizontal bars 39 and 39' which contact the surface 26 of coping 25. The chair is indicated generally by reference character 40 and has a back 41, a seat 42, a pair of arms 43 and 44 held to sides 35 and 36 at one end and two vertical bars 45 and 46 at the other end. Cross members 47, 48 and 49 hold the frame together and webbing 50 covers the seat 42 and webbing 51 covers the back 41.

Figure 6:
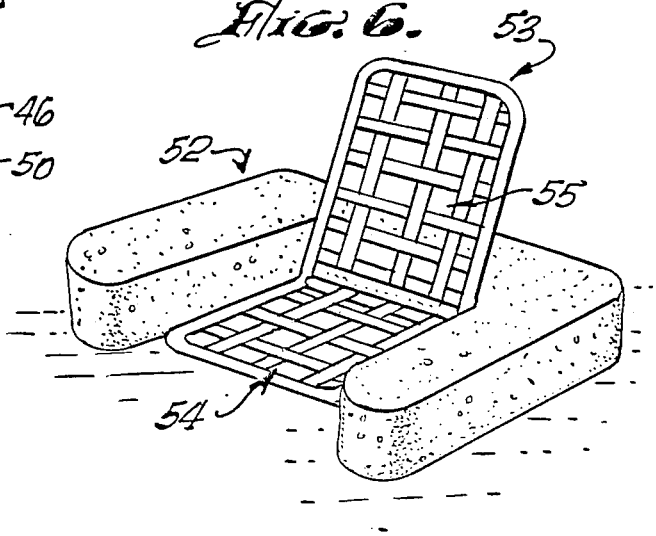
FIG. 6 is a perspective view of a prior art floating pool chair.

A prior art floating chair is shown in FIG. 6 and has a generally U-shaped float 52 which holds a chair 53. Chair 53 has a seat 54 and a back 55. As stated above, chair 53 floats in a random manner on the pool surface and tends to bob, which problems are solved by the chair of the present invention.

While the chair of the present invention has been shown as having polymeric tubing for a frame, other materials could, of course, be used. For instance, aluminum tubing could be used as a frame. Alternatively, vacuum formed, high impact polyethylene could be molded into a desired shape which would eliminate the frame and webbing and the coping supported bar could be affixed to the back of the chair and the pool side contact means connected either to the back at its base or to the seat portion. The important features are the existence of a generally horizontal coping supported bar together with a pool side contact bar and preferably a pair of pool side contact bars to provide additional support. Although the pool chair 10 shown in the drawings is shown as a single chair, the chair could be made wider to accommodate two or three persons. While the terms "generally horizontal" and "generally vertical" have been used, these terms of course, are intended to include the tilted version shown in the drawings.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A chair for use in a swimming pool, spa or other aquatic body of the type which is surrounded by coping and which has a pool side below the coping, said chair being supported on said coping and side of said swimming pool, spa or other aquatic body, said chair and pool side comprising:

pool coping means at the edge of a swimming pool, said pool coping means having a generally horizontal upper surface and said coping means having an edge at the edge of the pool, said edge being above a generally vertical pool side and said swimming pool including a water line below the pool coping means and pool sides below said water line; and a pool chair including a generally horizontal seat and a generally vertical back affixed to said seat at a point of intersection, said generally vertical back having two sides and having a coping supported bar affixed to the generally vertical back and positioned atop the pool coping means and extending away from the vertical back and over the edge of the pool coping, and said pool chair having pool side contact means located below the water line of the pool affixed to the pool chair and contacting the side of the swimming pool to hold the seat of the pool chair away from the side of the pool.

2. The pool chair of claim 1 wherein said chair has a frame having plastic sides and a woven strap back and seat.

3. The pool chair of claim 2 wherein the generally vertical back has plastic sides and there are two coping-supported bars affixed to said generally vertical back at the plastic sides thereof and each of said coping-supported bars are held to each other at their outer ends by a cross member.

4. The pool chair of claim 1 wherein said pool side contact means comprises two bars which are an extension of the generally horizontal seat and said two bars have outer ends adjacent said pool side.

5. The pool chair of claim 4 wherein said point of intersection between the seat and the back is a adjustable along a portion of said seat.

6. The pool chair of claim 4 wherein said side contact means comprises two bars extending from the sides of the generally vertical back.

7. The pool chair of claim 4 wherein said two bars are held to each other at their outer ends by a cross member.

8. The pool chair of claim 1 wherein said chair further includes a pair of arms affixed to the two sides of said generally vertical back at two points of contact.

9. The pool chair of claim 8 wherein the points of contact between the pair of arms and the sides is ajustable along a portion of said sides.

10. A chair supported on the coping and side of a swimming pool, spa or other aquatic body, said chair and pool side comprising:

pool coping means at the edge of a swimming pool, said pool coping having a surface sloping away from the pool edge, said coping means also having a pool edge above a generally vertical pool side and said swimming pool including pool sides and a water line below the pool coping means; and a pool chair including a generally horizontal seat and a generally vertical back affixed to said seat, said generally vertical back having two side members attached thereto and each of said side members having a coping supported bar affixed thereto and positioned atop the pool coping means and extending away from the side members and said side members having pool side contact means located below the water line of the pool affixed to the pool chair and contacting the side of the swimming pool to hold the seat of the pool chair away from the side of the pool.

11. The pool chair of claim 10 wherein said pool side contact means is attached to the side members of the generally vertical back.

12. The pool chair of claim 10 wherein said generally horizontal seat has two side members attached to the two side members of the generally vertical back.

13. The pool chair of claim 12 wherein said pool side contact means is affixed to the pool chair at the intersection of the side members of the generally horizontal seat.

14. The pool chair of claim 13 wherein the side contact means comprise two bars extending away from the vertical sides and the two bars being attached at their outer ends by a cross member.

15. A chair for use in a swimming pool, spa or other aquatic body of the type which is surrounded by coping and which has a pool side below the coping, said chair being supported on said coping and side of said swimming pool, spa or other aquatic body, said chair and pool side comprising:

pool coping means at the edge of a swiming pool, said pool coping having a generally horizontal upper surface and said coping means having an edge at the edge of the pool, said edge being above a generally vertical pool side and said swimming pool including a wear line below the pool coping means and pool sides below said wear line; and a pool chair including a generally horizontal seat having a front bar and two side bars and a generally vertical back attached to said seat, said generally vertical back having a base and two sides affixed to the two side bars of the seat and having a coping supported bar affixed to the generally vertical back and positioned atop the pool coping means and extending away from the vertical back and over the edge of the pool coping and said pool chair having pool side contact meams located below the water line of the pool affixed to the two side bars of the seat as an extension thereof and said side contact means contacting the side of the swimming pool to hold the seat of the pool chair away from the side of the pool.

16. The pool chair of claim 1 wherein the point of attachment of the generally vertical back to the two side bars of the seat is slidingly adjustable along the two side bars so that the distance of the base of the generally back from the pool side may be adjusted.

* * * * *